US006622442B2

(12) United States Patent
Kwon

(10) Patent No.: US 6,622,442 B2
(45) Date of Patent: Sep. 23, 2003

(54) COMBINATION LIGHT-WEIGHT DECK FORM, WITH CONNECTORS

(76) Inventor: Heug Jin Kwon, 206 Ryerson Rd., Lincoln Park, NJ (US) 07035

( * ) Notice: Subject to any disclaimer, the term of this patent is extended or adjusted under 35 U.S.C. 154(b) by 0 days.

(21) Appl. No.: 09/916,878

(22) Filed: Jul. 30, 2001

(65) Prior Publication Data

US 2003/0019177 A1 Jan. 30, 2003

(51) Int. Cl.[7] ..... E04B 1/00

(52) U.S. Cl. ..... 52/259; 52/309.12; 52/583.1; 403/348; 403/350

(58) Field of Search ..... 52/258, 259, 309.12, 52/309.17, 583.1, 602; 403/350, 348; 411/349, 549, 553, 554; 14/73, 73.1

(56) References Cited

U.S. PATENT DOCUMENTS 1,987,474 A * 1/1935 Grant
3,260,175 A * 7/1966 Crone
3,269,071 A * 8/1966 Johnson
4,090,336 A * 5/1978 Carroll
4,145,153 A * 3/1979 Fasullo et al.
4,619,096 A * 10/1986 Lancelot, III
4,785,600 A * 11/1988 Ting
4,942,707 A * 7/1990 Huettemann
5,246,322 A * 9/1993 Salice
5,444,957 A * 8/1995 Roberts
5,454,128 A 10/1995 Kwon
5,509,243 A * 4/1996 Bettigole et al.
5,606,839 A * 3/1997 Baumann
6,099,196 A * 8/2000 Lancelot, III
6,101,779 A * 8/2000 Davenport
6,256,957 B1 * 7/2001 Kelly

* cited by examiner

*Primary Examiner*—Blair M. Johnson
(74) *Attorney, Agent, or Firm*—Stanley J. Yavner

(57) ABSTRACT

The disclosure sets forth pre-fabricated deck forms and reinforcement bar connectors for light-weight concrete decks on bridges. The three different types of deck forms disclosed provide light-weight and composite concrete decks for bridges, with reinforcement bars, longitudinal beam stiffeners and thin plates, and the longitudinal beam stiffeners, welded to the thin plates. The thin plates are attached to the bottom flanges of the longitudinal beam stiffeners for the first two types, and to the web plates of those stiffeners, for the third type. The bottom portion of the first two types of deck forms disclosed are filled with filler material, such as styrofoam or similar non-metallic material. In one type, the filler material is provided under the concrete slab only proximate the longitudinal beam stiffeners, and the thin plate is corrugated. In the second type, the thin plate is planar, and the filler material completely fills the lower half of the area between the longitudinal beam stiffener and the bottom flanges thereof, to which the planar thin plate is attached. The third type of form uses a thin plate, as well, but without filler material, the thin plate adhering to the longitudinal beam stiffeners at a position similar to the position of the valleys of the corrugations in the first type of form.

3 Claims, 5 Drawing Sheets

COMBINATION LIGHT-WEIGHT DECK FORM, WITH CONNECTORS

FIELD OF THE INVENTION

This invention relates primarily to reinforcement bar connectors for construction joints between concrete deck forms for bridges, and for providing light-weight concrete deck forms for bridges, with the mechanical bar connectors being useful also for any reinforced concrete structure, to connect the reinforcement bars.

BACKGROUND OF THE INVENTION

In recent years, vehicles that are heavier and faster-moving, with their constant pounding on bridges, have presented problems of reliability and durability for the concrete decks of bridges to a significant extent. Of course, bridge superstructures have been made more redundant and it has been attempted to reduce the dead weight of the bridge. In making these changes, it has become increasingly important to quickly accomplish any bridge repairs in order to avoid prolonged traffic congestion. Therefore, it would be helpful to provide simple, reliable and durable deck forms and connectors in a manner which confronts not only the goals of a quicker installation time, but also to meet the requirements of safety in concrete bridge deck construction, but also for repair on bridges.

Also, it is an urgent need in this area, to provide a construction and installation element for bridges, which allows for prefabrication without sacrificing durability and reliability, in order to further shorten the time period for interrupting traffic during construction or repair of such bridges.

OBJECTS AND SUMMARY OF THE INVENTION

Accordingly, a primary object of the present invention is to provide a light-weight and durable, and yet reliable structure for a concrete bridge deck form.

It is a further and more particular object of the present invention to provide a structure for a concrete bridge deck form which is capable of prefabrication and installation, in a quick and reliable manner.

These and other objects of the present invention are provided in a bridge deck form which features preferred and alternative embodiments of light-weight concrete deck forms for bridges and reinforcement bar connectors for easy installation, which enables prefabrication thereof and quick and reliable installation, as well as durability. The form itself includes reinforcement bars, longitudinal beam stiffeners and thin plates, welded to the beam stiffeners. In the preferred embodiment, the thin plates are attached to the bottom flanges of the longitudinal beam stiffeners, whether they be in the form of T-beams or I-beams. For that preferred embodiment, the thin plate is corrugated with hills and valleys, and with the valleys occurring approximately midway between longitudinal beam stiffeners, and the "hills" attached to the bottom flange of the longitudinal beam stiffeners. In an alternative embodiment, the thin plate is planar, attached to the bottom flanges and generally planar therewith. In either event, for the preferred embodiment or the alternative embodiment mentioned above, the space below the concrete slab, between the thin plate and the top portion or top flange (inverted T-beam and I-beam, respectively) of each longitudinal beam stiffener has filler material (styrofoam or similar material). A further alternative embodiment does not have filler material of styrofoam or similar material, as with the preferred and first alternative embodiments, but instead the thin plate attaches in a generally planar configuration to web plates near the upper portion of the longitudinal beam stiffeners. For purposes of quick and reliable fabrication at the site of the bridge, a preferred and alternative mechanical connector for the above prefabricated deck forms includes a male connector element and a female connector element, wherein each includes V-shaped grooves occupying less than one-quarter of the circumference for the male member and the female member at two opposed positions of the circular shape. Accordingly, with the balance of the circular male element and female opening hole having smooth surfaces, the connection between the members for connecting reinforcement bars, requires only insertion and a quarter turn to mechanically connect reinforcement bars of concrete slab elements. Therefore, original fabrication of bridge decks, with prefabricated concrete slabs is quick and reliable; and replacement of broken concrete slabs is also quick and reliable.

BRIEF DESCRIPTION OF THE DRAWINGS

Other objects, features, advantages and embodiments of the present invention will become apparent by the following more detailed description of the preferred and alternative, but nonetheless illustrative, embodiments with reference to the accompanying drawings, wherein.

DETAILED DESCRIPTION OF THE PREFERRED AND ALTERNATIVE EMBODIMENTS

Figure 1A:
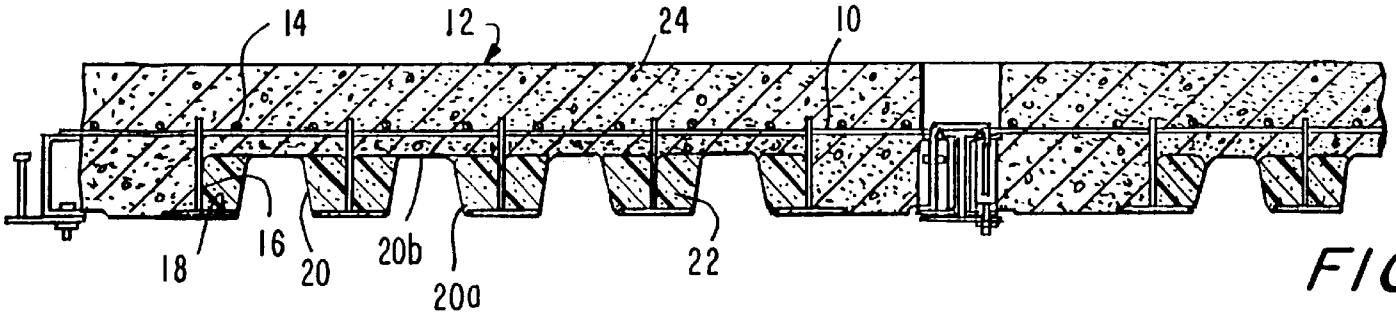
FIGS. 1A–1C are cross-sectional views taken along the line 1—1 of FIG. 2, or for FIG. 1C in a similar direction, of illustrating the length of the transverse reinforcement bars, and illustrating, respectively, the three types of a thin plate placement, and the use of light-weight fillers, useful in deck forms of the present invention.
Figure 1B:
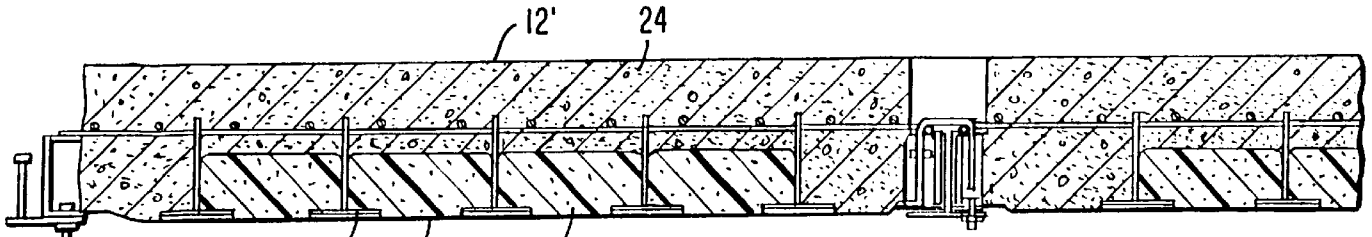
Figure 1C:
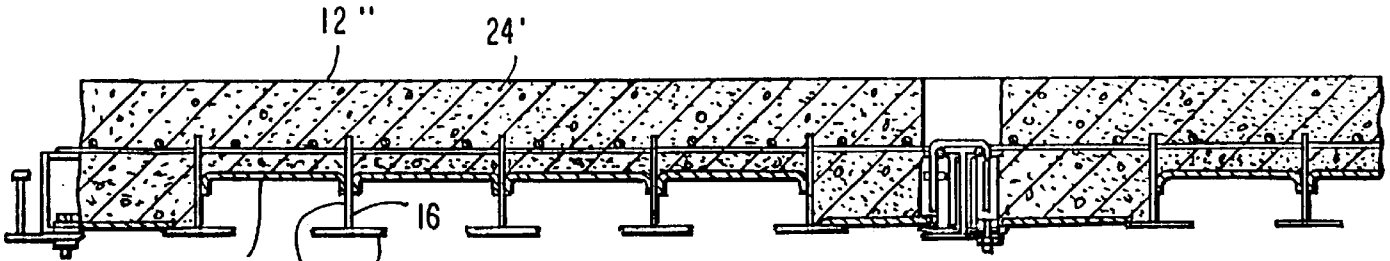

Referring to the drawings, and particularly FIGS. 1A–1C, cross-sectional views are shown to illustrate transverse reinforcement bars 10 of prefabricated, light-weight deck forms generally designated 12. The longitudinal reinforcement bars 14 are arranged perpendicular to the transverse reinforcement bars 10. Longitudinal beam stiffeners 16 are shown in FIGS. 1A–1C in the form of an inverted T-shape, with the bottom flange 18 of the longitudinal beam stiffeners having welded to them a light-guage, thin plate 20.

In FIG. 1A, the thin plate 20 is in corrugated form with hills 20*a* and valleys 20*b*, so that thin plate 20 encompasses filler material 22, using a non-metallic material such as styrofoam or the like.

In an alternative embodiment, thin plate 20' is shown in FIG. 1B as extending in the transverse direction of form 12' without hills and valleys to enclose filler material 22'. As with FIG. 1A, the embodiment of FIG. 1B shows the use of filler material 22 and 22' as filling the tensile stressed area in forms 12 and 12'. Accordingly, with the concrete 24 acting as a compression member, but not as a tension member, and therefore, if used in the areas of FIG. 1A and FIG. 1B where filler material 22, 22' is placed under the concrete slab 24, the concrete would function as dead weight.

The filler material 22, 22' is much lighter than concrete, but gives more structural redundancy to the form, due to the lighter weight. Also, the reduction of concrete dead weight in prefabricated deck forms 12, 12' provides more structural efficacy to the main beams of the bridge supporting the concrete deck forms. Accordingly, the prefabricated deck forms 12, 12' work as composite members in the structure. Furthermore, the corrugated or planar thin plates 20, 20' function as tension members with beam stiffeners 16 in a longitudinal composite action. Corrugated thin plate 20 in FIG. 1A provides more longitudinal rigidity, but less transverse rigidity to the prefabricated deck form 12, than the planar thin plate 20'. However, planar thin plate 20' has less longitudinal rigidity but greater transverse rigidity than the corrugated thin plate, so that in the transverse composite action, planar thin plate 20' resists tensile force, with the concrete slab 24 resisting compression force. Accordingly, the FIG. 1B embodiment tends to more evenly distribute the live load of the bridge in the transverse direction than the preferred embodiment of FIG. 1A.

Another alternative embodiment is shown in FIG. 1C. In FIG. 1C, the thin plate 20" does not enclose a filler material, and instead of being welded to bottom flange 18 of beam stiffener 16, such thin plates attach to web plates 16*a* of beam stiffener 16, with an area of space below the thin plates, which underlie concrete slabs 24'. The reduction, thereby, in the weight of the concrete which would otherwise be in the area of space, provides more structural redundancy and efficiency to deck form 12".

Therefore, FIG. 1C embodiment, thin plates 20" function as forms for concrete slab 24'. Accordingly, the prefabricated deck form 12" in FIG. 1C functions as a composite with concrete slab 24', such that beam stiffener 16 resists tensile force, while concrete slab 24' resists compressive force in the longitudinal direction.

In all of the embodiments of FIGS. 1A–1C, the grid system made by the perpendicularly arranged transverse and longitudinal reinforcement bars 10, 14, near the top surface of concrete slab 24, 24', absorb temperature and live loads transmitted through the surface of the concrete and evenly distribute such temperature and live loads to prevent the concrete from cracking. The transverse rebars 10 resist the shear force transmitted in the transverse direction. Longitudinal reinforcement bars 14 resist compressive force with concrete slab 24, in the positive bending moment area, while they resist tensile force in the negative bending area.

Figure 2:
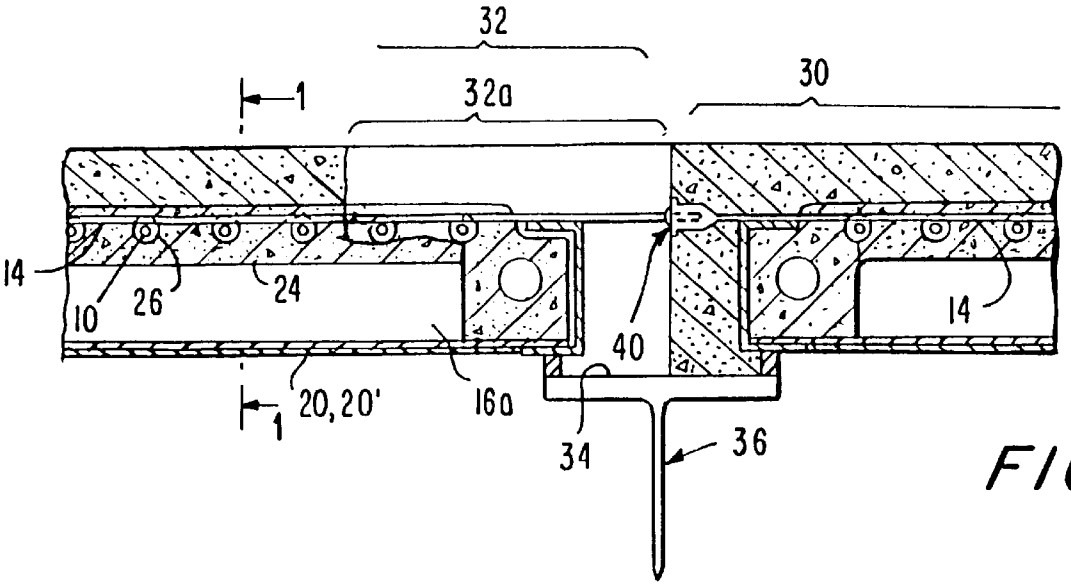
FIG. 2 is a partial sectional view, showing the lengthwise illustration of the longitudinal reinforcement bars, generally at a ninety degree angle from the direction of view of FIGS. 1A–1C, and depicting a reinforcement bar connector in a preferred form for use with the deck forms of FIGS. 1A–1C.
Figure 3:
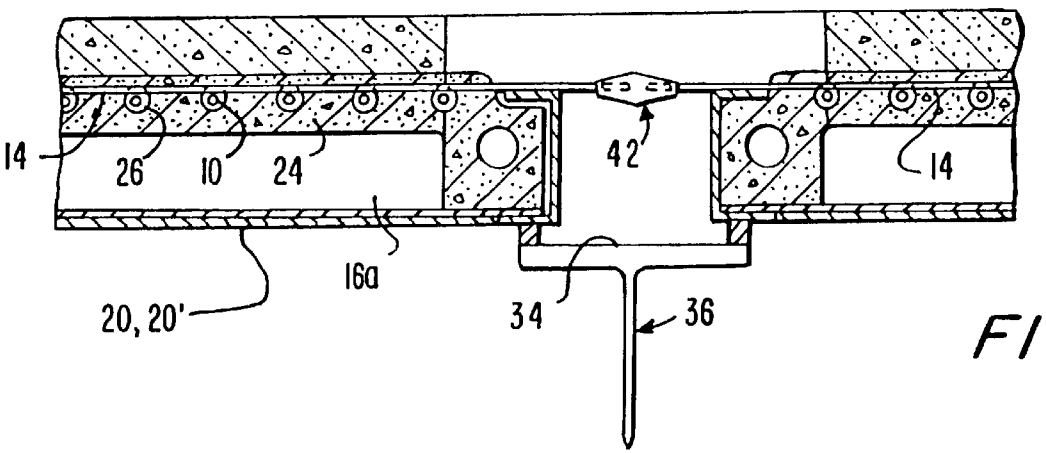
FIG. 3 is a view similar to FIG. 2, but showing an alternative embodiment for the mechanical connector for connecting longitudinal reinforcement bars.
Figure 4:
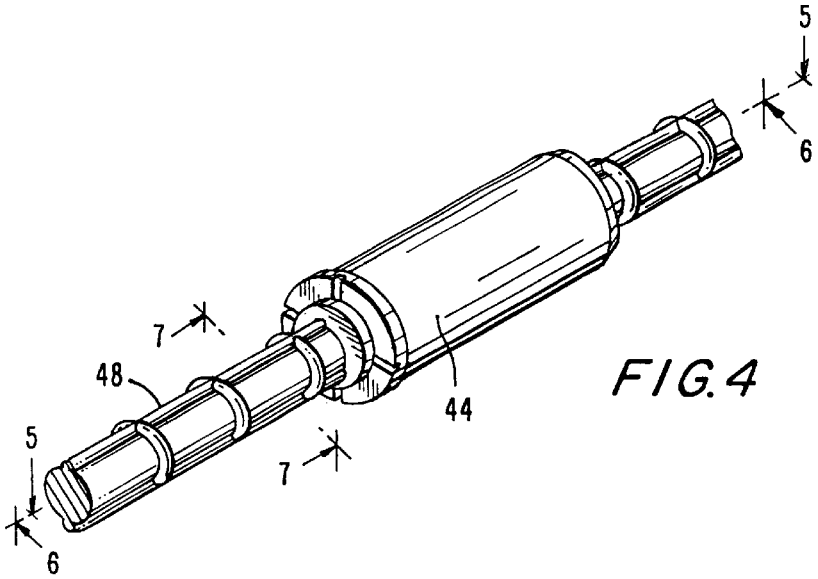
FIG. 4 is an isometric view of the reinforcement bar mechanical connector illustrated in FIG. 2, showing the reinforcement bars connected; i.e. after the quarter turn to connect male and female V-grooves.

Transverse reinforcement bars 10 align the longitudinal reinforcement bars 14 extending to the holes 26 defined by web plates 16*a* (FIGS. 2, 3). Holes 26, together with transverse reinforcement bars 10 enable the beam stiffeners 16 to be completely embedded in the concrete slab 24, so that the beam stiffener and thin plates 20, 20', 20" work as a composite part of concrete slab 24. Therefore, the major role of the web plate 16*a* is to sustain shear force in the prefabricated deck form 12, 12', 12". Concrete slab 24, 24' are placed in the deck forms 12, 12', 12".

Referring particularly to FIGS. 2 and 3, the right side of such drawings 30 represents a showing of a bridge deck form 12 completed in the field; and the left sides of such drawings indicate deck forms 12 under construction. The longitudinal reinforcement bars 14 in stage 32 must therefore be connected to the longitudinal reinforcement bars 14 in the finished stage 30, in order to resist tensile force in the concrete slab 24 above the top flange 34 of bridge main beams generally designated 36, since any improper rebar connection in the negative bending area could cause cracks in the concrete slab due to high tensile stress therein. Conventional connectors have suffered from the drawback that splicing of such rebars requires relatively more labor and time due to the difficulties in using and ineffectiveness involved in the design of such conventional connectors. The present invention provides a solution to the problem by use of novel connectors (FIGS. 2, 3) generally designated 40, 42.

Figure 5:
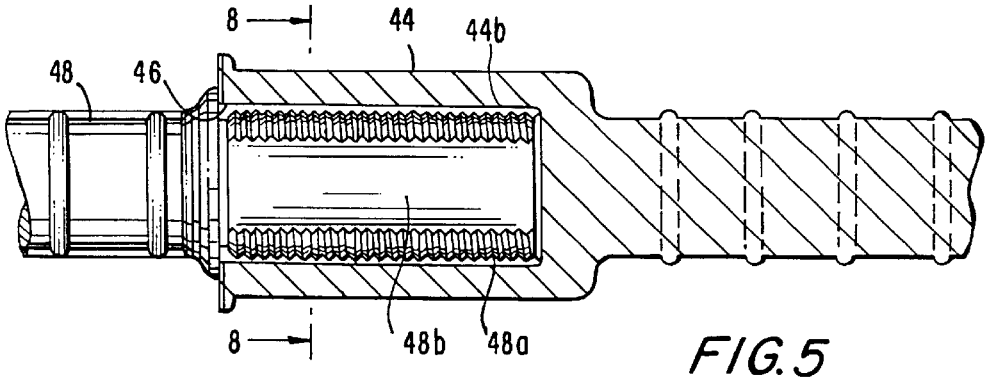
FIG. 5 is a top sectional view taken along the line 5—5 of FIG. 4, but with the male member 48 shown in the position of insertion to the female member, before the quarter turn to connect the members, and illustrating the V-shaped grooves of the male connector before the quarter turn of the male connector.
Figure 6:
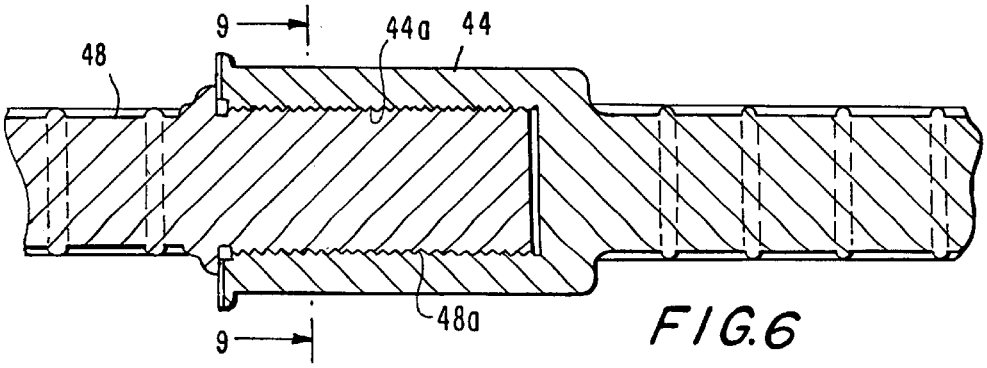
FIG. 6 is a front sectional view taken along the line 6—6 of FIG. 4, and showing the male connector after the quarter turn, with its threads or V-shaped grooves coupled to those of the female opening.
Figure 11:
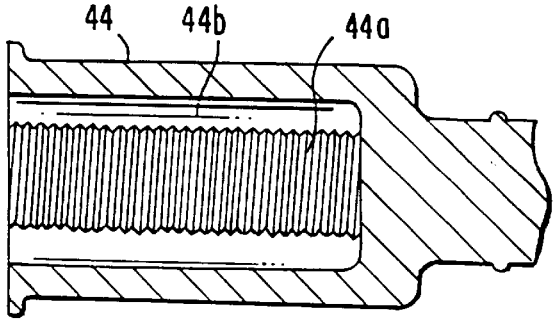
FIG. 11 is a view similar to FIG. 5, but showing the female receptacle element only before engagement by the male element V-grooves.

FIGS. 2, 4–11 represent the preferred embodiment of mechanical connector 40, wherein a female receptacle element 44 defining female opening 46 is mated with male connector element 48. Male connector element 48, in cross-section (FIGS. 7–9), is circular, with the round circumferential surface defining either threads or V-shaped grooves 48*a* and smooth surfaces 48*b* (FIG. 5). In the preferred embodiment, the V-shape, grooved portions 48*a*, are initially inserted to receptacle opening 46 of the female receptacle element 44, with such V-shaped grooved portions 48*a* at the sides of male connector element 48 (in the orientation of FIG.4), in the area to be inserted into female connector element 44. Such V-shaped grooves 48*a* (FIG. 10), each occupy less than one-quarter of the circumferential surface of the male plug; and there are complementary V-shaped grooves 44*a* (FIG. 9) in the receptacle opening 46 of the female element, but with the female V-grooves occupying less than two separate quarter rounds on the inside of the receptacle opening 46 (FIG. 11). Of course, as stated in the Brief Description of the Drawings, FIG. 11 is similar to FIG. 5, in that it is a top sectional view from FIG. 4, so the female V-shaped groves are shown in FIG. 11 at the top and bottom of the receptacle opening 46. Accordingly, the FIG. 5 male connector element 48 V-shaped grooves 48*a* are inserted touching the smooth receptacle surfaces of the female receptacle element 44*b*.

Figure 7:
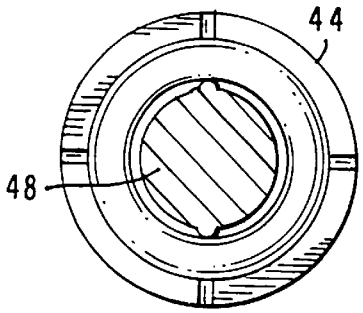
FIG. 7 is a left side sectional view taken along the line 7—7 of FIG. 4 and showing the male and female connectors after the one quarter turn following insertion.
Figure 8:
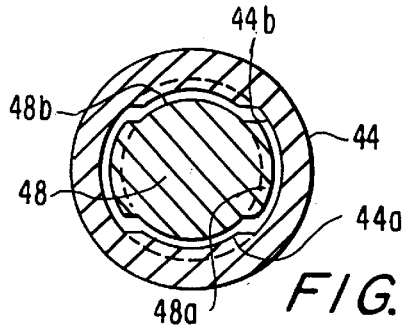
FIG. 8 is a sectional view, taken along the line 8—8 of FIG. 5, similar to that of FIG. 7, but showing the male and female connectors upon insertion, and before one-quarter turn of the male.
Figure 9:
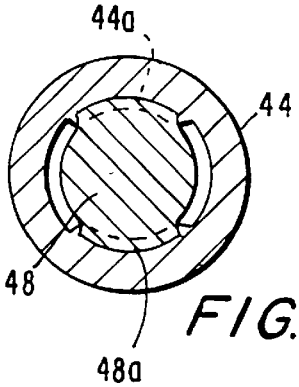
FIG. 9 is a left side cross-sectional view taken along the line 9—9 of FIG. 6, similar to FIG. 8, but showing the male and female connectors after the one-quarter turn to connect them is performed.
Figure 10:
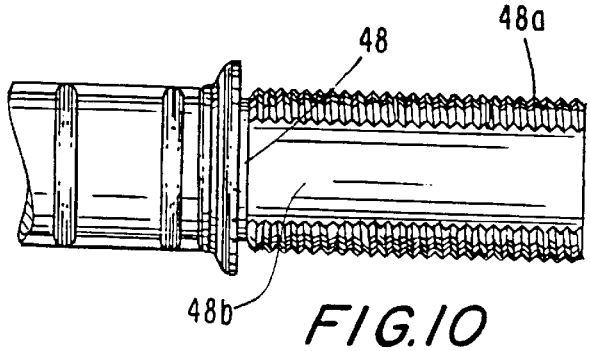
FIG. 10 is a view similar to FIG. 5, but showing only the male connector element before its quarter turn is made to engage it with the female receptacle element.

The male element 48 is then turned a quarter turn to the point shown in FIG. 7, to engage the female element, as is more specifically shown in FIG. 9. Thereby the V-grooves of each connector element, male and female, are interlocked (FIG. 9), the quarter turn having been made from the insertion position of FIG. 8.

Alternatively, male connector rebars 48 are spliced with longitudinal rebars 14 in the open space 32*a* in FIG. 2, and that space grouted in the field.

Figure 12:
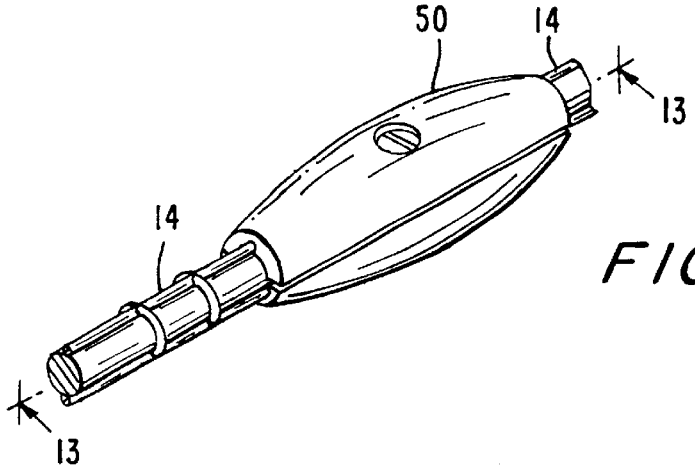
FIG. 12 is an isometric view showing an alternative structure for a connector element illustrated in FIG. 3 useful in the present invention and illustrating inserted and connected male connectors in the double female receptacle connector.
Figure 13:
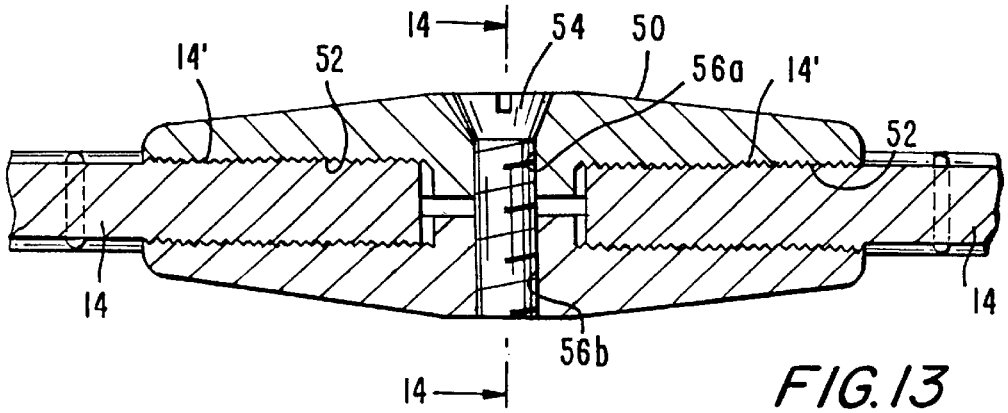
FIG. 13 is a front sectional view taken along the line 13—13 of FIG. 12, and illustrating more clearly the fastening bolt for holding the split double female connector together in engagement with the male connectors.
Figure 14:
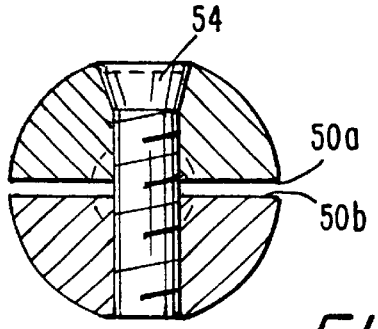
FIG. 14 is a side sectional view taken along the line 14—14 of FIG. 13 through the fastening bolt, illustrating particularly the split halves of the female connector of the alternative embodiment.

Also as an alternative embodiment, a connector element 42 of FIG. 3, additionally as shown in FIGS. 12–14, is used. Relating to the preferred connector embodiment of FIGS. 4–9, the male element is replaced by matching ends of longitudinal reinforcement bars 14, without male or female connecting elements at the ends thereof, but instead with threads or V-shaped grooves 14' thereon (FIG. 13). Female double element 50 connects to both. The threaded or V-shaped grooved ends 14' of longitudinal reinforcement bars 14 in FIG. 13 cover the circumference of such rebars 14. Likewise, the internal openings 52 of female double element 50 are half-round threaded or with V-shaped grooves, so that the insertion of rebars 14 is accomplished by the split halves 50*a*, 50*b* being placed over rebars 14 with the V-grooves matched to interlock male rebars 14. Screw 54 is then inserted and fastened through smooth round hole 56*a* in top female element 50*a* and then into threaded opening 56*b* defined by female bottom element 50*b* (FIG. 13), so that the two halves 50*a*, 50*b* are held together with the grooves mating. In this manner, with either the connector of FIGS. 3, 12–14 or the preferred embodiment of connector shown in FIGS. 2, 4–11, or the alternative described with reference thereto, the connectors can reliably sustain the structural integrity of the entire form 12 or the tension and compression forces they are called upon to sustain.

In more detail as to FIGS. 12–14, the first male connector element is replaced by longitudinal reinforcement bars 14, and they are provided with threads or V-shaped grooves 14' thereon; and female double element 50, with split halves 50*a*, 50*b* are for placement over rebars 14, with all being engaged in the structure by use of screw 54. The female element uses threaded or V-shaped grooves on half round internal openings, and the male connecting members have the full round of their circumferences with threaded or V-shaped grooves.

What is claimed is:

1. A light-weight deck form for prefabrication and replacement of sections of a bridge roadway comprising a slab of concrete having longitudinal reinforcement bars, and transverse reinforcement bars generally perpendicular to said longitudinal reinforcement bars, longitudinal beam stiffeners supporting said slab, each having a bottom flange and a web plate generally perpendicular to said flange, and a thin plate welded to said longitudinal beam stiffeners, and mechanical connectors for connecting said longitudinal reinforcement bars to longitudinal reinforcement bars of another deck form, each of said connectors comprising a first generally cylindrical male connector element and a second female connector element, said elements being axially aligned with each other and with respect to one of said longitudinal reinforcement bars, said second female connector element defining a generally cylindrical opening for insertion of said first generally cylindrical male connector element, for engaging said second female connector element with said first generally cylindrical male connector element by rotating said first generally cylindrical male connector element one-quarter turn, each of said first generally cylindrical male connector element and said opening defining over less than all of their surfaces a means for connecting one to the other, including multiple, less than quarter-round sections defining interlocking elements, to provide a facility for placement of said first generally cylindrical male connector element into said opening and to thereafter engage said second female connector element with said first generally cylindical male connector element, said means for connecting defined by said first generally cylindrical male connector element including V-shaped grooves, and said means for connecting defined by said opening also including V-shaped grooves.

2. A light-weight deck form for prefabrication and replacement of sections of a bridge roadway comprising, in combination, a slab of concrete having longitudinal reinforcement bars, and transverse reinforcement bars generally perpendicular to said longitudinal reinforcement bars, longitudinal beam stiffeners for supporting said slab, each having a bottom flange and a web plate generally perpendicular to said flange, a thin plate affixed to said longitudinal beam stiffeners, holes defined by said web plate, into which said transverse reinforcement bars extend, so that said beam stiffener and said thin plate function as a composite part of said concrete slab, thereby to enable said web plate to sustain shear force in said deck form wherein mechanical connectors are provided for connecting said longitudinal reinforcement bars to longitudinal reinforcement bars of another deck form, each of said connectors including a first generally cylindrical connector element having V-shaped grooves occupying less than two separated quarter-rounds of the circumference of said cylindrical connector element for interlocking with a second cylindrical connector element of said other deck form, one of said first and second elements being male in form and the other being female in form.

3. A light-weight deck form for prefabrication and replacement of sections of a bridge roadway comprising, in combination, a slab of concrete having longitudinal reinforcement bars, and transverse reinforcement bars generally perpendicular to said longitudinal reinforcement bars, longitudinal beam stiffeners for supporting said slab, each having a bottom flange and a web plate generally perpendicular to said flange, a thin plate affixed to said longitudinal beam stiffeners, holes defined by said web plate, into which said transverse reinforcement bars extend, so that said beam stiffener and said thin plate function as a composite part of said concrete slab thereby to enable said web plate to sustain shear force in said deck form, wherein mechanical connectors are provided for connecting said longitudinal reinforcement bars to longitudinal reinforcement bars of another deck form, said longitudinal reinforcement bars being generally cylindrical in shape, each of said connectors having top and bottom connector elements, each of said top and bottom connector elements defining facing half female openings to form with the other connector element, female openings, V-shaped grooves on said female openings, a screw for holding said top and bottom connector elements together, and the ends of said longitudinal reinforcement bars having V-shaped grooves thereon to provide an interlocking relationship between said longitudinal reinforcement bars and said female openings.

* * * * *